US006075228A

United States Patent [19]

Goto et al.

[11] Patent Number: 6,075,228

[45] Date of Patent: Jun. 13, 2000

[54] IMAGE HEATING DEVICE WITH BIMETAL THERMOPROTECTOR

[75] Inventors: Masahiro Goto; Hiroto Hasegawa, both of Mishima; Yuko Okama, Yokohama; Yozo Hotta, Susono, all of Japan

[73] Assignee: Canon Kabushiki Kaisha, Tokyo, Japan

[21] Appl. No.: 09/109,198

[22] Filed: Jul. 2, 1998

[30] Foreign Application Priority Data

Jul. 3, 1997 [JP] Japan ..... 9-192083

[51] Int. Cl.[7] ..... H05B 1/00

[52] U.S. Cl. ..... 219/216; 399/69; 399/329

[58] Field of Search ..... 219/216, 469–491; 399/69, 328–335

[56] References Cited

U.S. PATENT DOCUMENTS

| | | | |
|---|---|---|---|
| 4,322,158 | 3/1982 | Frias et al. | 219/216 |
| 5,019,692 | 5/1991 | Nbedi et al. | 219/469 |
| 5,262,834 | 11/1993 | Kusaka et al. | 399/329 |
| 5,286,950 | 2/1994 | Sakata | 219/469 |
| 5,404,214 | 4/1995 | Yoshimoto et al. | 399/329 |

FOREIGN PATENT DOCUMENTS

| | | |
|---|---|---|
| 63-313182 | 12/1988 | Japan . |
| 2-157878 | 6/1990 | Japan . |
| 4-27972 | 1/1992 | Japan . |
| 4-44075 | 2/1992 | Japan . |
| 4-204980 | 7/1992 | Japan . |

*Primary Examiner*—Joseph Pelham
*Attorney, Agent, or Firm*—Fitzpatrick, Cella, Harper & Scinto

[57] ABSTRACT

An image heating device includes a heater generating heat upon electric power supply, and a film whose one surface slidably contacts the heater, and whose other surface moves together with a recording material bearing an image while contacting the recording material. The image on the recording material is heated by heat from the heater through the film. The device also includes a thermoprotector having a bimetal which mechanically changes in order to disconnect electric power supply to the heater when there is an excessive temperature rise. The bimetal of the thermoprotector contacts the heater.

9 Claims, 8 Drawing Sheets

IMAGE HEATING DEVICE WITH BIMETAL THERMOPROTECTOR

BACKGROUND OF THE INVENTION

1. Field of the Invention

The present invention relates to an image heating device for an image forming apparatus which adopts an electrophotographic recording method or an elestrostatic recording method.

2. Description of the Related Art

Conventionally, heat-roller-type devices are widely used as thermal fixing devices applied to image forming apparatuses which adopt an electrophotographic or an electrostatic recording method. Thermal fixing methods that use thin films in which a toner image on a recording material is fixed by providing a film between a stationary heater unit and a pressing roller are known. With such devices it is not necessary to supply a heating fixing device with electric power in a standby state and they are able to minimize electric power consumption. Thin film fixing devices have been proposed, for example, in Japanese Patent Laid-Open Application (Kokai) Nos. 63-313182 (1988), 2-157878 (1990), 4-44075 (1992) and 4-204980 (1992).

FIGS. 7, 8(*a*) and 8(*b*) illustrate a device according to the film heating method which constitutes a background technique of the present invention.

FIG. 7 is a schematic diagram illustrating the configuration of a principal portion of a thermal fixing device according to the film heating method. FIGS. 8(*a*) and 8(*b*) are schematic diagrams illustrating the configuration of a heater of the device shown in FIG. 7.

As shown in FIG. 7, a stay holder 102, serving as a supporting member for supporting a heater 101 and guiding a fixing film 103, is provided. The heater 101, serving as a heating member, is fixed and supported on the stay holder 102. The fixing film 103 comprising a heat-resistant thin film is provided around the stay holder 102. The heating fixing device is configued by pressing an elastic pressing roller 110 against the heater 101 via the fixing film 103, to form a nip portion (fixing nip portion) N having a predetermined nip width. By passing a recording material P through the nip portion N, a toner image t on the recording material P can be fixed by being pressed and fused.

The stay holder 102 is made, for example, of a heat-resistant plastic material. The stay holder 102 holds the heater 101, and also operates as a conveying guide for the fixing film 103.

The heater 101 generally comprises a ceramic heater. For example, the heater 101 is configured by forming a current-passing heating resistive layer 101*b*, made of silver/palladium (Ag/Pd), Ta2N or the like, on a surface of a ceramic substrate 101*a*, which has an excellent electric insulating property, an excellent thermal conductivity and a low heat capacity and which is made of alumina or the like, facing the fixing film 103 in the longitudinal direction of the substrate 101*a* according to screen printing or the like, and providing a glass protective layer 101*c* covering the surface of the heating resistive layer 101*b*.

By passing current through the current-passing heating resistive layer 101*b*, the current-passing heating resistive layer 101*b* is heated, so that the temperature of the entire heater 101 including the ceramic substrate 101*a* and the glass protective layer 101*c* is rapidly raised. The temperature rise of the heater 101 is detected by temperature detection means 104 (see FIG. 8(*b*)) provided on the back surface of the heater 101, and the result of the detection is fed to a current control unit (not shown). The current control unit controls current supply to the current-passing heating resistive layer 101*b* so that the temperature of the heater 101 detected by the temperature detection means 104 is maintained at a predetermined substantially constant temperature (fixing temperature). Thus, the heater 101 is heated and controlled to the predetermined fixing temperature.

The fixing film 103 disposed around the stay holder 102 is in the shape of a cylinder, an endless belt, or a rolled web having finite ends, and is conveyed in the direction of an arrow "a" while slidably contacting the surface of the heater 101 at the fixing nip portion N, by driving means, or the rotational force of the pressing roller 110.

In order to efficiently provide the recording material P, serving as a material to be heated, with the heat of the heater 101 at the fixing nip portion N, the fixing film 103 has a thickness of 20–70 $\mu$m and therefore is considerably thin. The fixing film 103 has three layers, i.e., a film base layer, a primer layer and a releasing layer. The film base layer faces the heater 101, and the releasing layer faces the pressing roller 110.

The film base layer of the fixing film 103 is made of polyimide, polyamideimide, PEEK or the like which is more insulating than the glass protective layer 101*c* of the heater 101, and which has a heat-resistive property and high elasticity. The film base layer provides the mechanical strength, such as the tearing strength or the like, of the entire fixing film 103. The primer layer is a thin layer having a thickness of about 2–6 $\mu$m. The releasing layer is a layer for preventing toner offset with respect to the fixing film 103, and is made of a fluororesin, such as PFA, PTFE (polytetrafluoroethylene), FEP or the like, having a thickness of about 10 $\mu$m.

In the heating device of the film heating method using such a thin fixing film 103, the pressing roller 110 having an elastic layer 111 is flattened at a pressed portion so as to follow the flat lower surface of the heater 101 due to high rigidity of the ceramic heater 101, to form the fixing nip portion N having a predetermined width. The fixing nip portion N is heated by the heater 101, so that quick-starting thermal fixing is realized.

When the recording material P, serving as the material to be heated, bearing an unfixed toner image t formed on a surface thereof is guided between the fixing film 103 and the pressing roller 110 at the fixing nip portion N in a state in which the heater 101 is heated and controlled at a predetermined temperature and the fixing film 103 is conveyed in the direction of the arrow "a", the recording material P is conveyed together with the fixing film 103 through the fixing nip portion N in a state in which the recording material P is in close contact with surface of the fixing film 103. The recording material P and the toner image t are heated by the heater 101 via the fixing film 103 at the fixing nip portion N, so that the toner image t is heated and fixed on the recording material P. A portion of the recording material P passing through the fixing nip portion N is peeled from the surface of the fixing film 103 and is conveyed.

FIGS. 8(*a*) and 8(*b*) illustrate the positional relationship between the current-passing heating resistive layer 101*b* of the heater 101, and the pressing roller 110. As shown in FIG. 8(*a*), the width W of the current-passing heating resistive layer 101*b* of the heater 101 in the longitudinal direction is slightly smaller than the width D of the elastic layer 111 of the pressing roller 110 contacting the current-passing heating resistive layer 101*b* via the fixing film 103, and is slightly larger than the conveying region of the recording material P bearing the toner image t formed thereon.

According to this configuration, the heat generated by passing current through the current-passing heating resistive layer 101*b* of the heater 101 is supplied to the recording material P as it is conveyed between the fixing film 103 and the pressing roller 110, to fuse the toner image t on the recording material P. The toner image t is solidified to form an image on the recording material P. Reference numeral 106 represents AC electrode portions.

As shown in FIG. 8(*b*), a temperature detection device 104, such as a thermistor or the like, and a thermoprotector 105, such as a temperature fuse, a thermostat or the like, for disconnecting current supply to the current-passing heating resistive layer 101*b* of the heater 101 during runaway are provided so as to contact the back surface of the heater 101 within the conveying region for a minimum-width recording material P which can be conveyed in the image forming apparatus. Reference numeral 107 represents DC electrode portions.

The temperature detection device 104 is provided within the minimum conveying region of the recording material so as to heat and fix the toner image t on the recording material P at an appropriate fixing temperature without causing problems, such as a failure in fixing, high-temperature off-set and the like, even when the minimum-width recording material P which can be conveyed in the main body of the image forming apparatus is conveyed.

The thermoprotector 105 is provided within the minimum conveying region of the recording material so as not to cause problems, such as disconnection of current supply, and the like, by misoperation of the thermoprotector 105, even during ordinary conveyance, due to overheating in the nonconveying region, having a smaller heat resistance than the conveying region, when the minimum-width recording material P is conveyed.

In the above-described heating fixing device of the film heating method, in order to improve the quick starting property, the thickness of the ceramic substrate 101*a* is minimized for the purpose of minimizing the necessary heat capacity of the heater 101. In this configuration, if the response of the thermoprotector 105 is not so good, there is the problem that, when the control unit for controlling current supply to the current-passing heating resistive layer 101*b* of the heater 101 or a safety circuit fails, i.e., when current supply to the current-passing heating resistive layer 101*b* runs away, the heater is, in some cases, destroyed due to overheating of the heater 101 and from the pressure provided in order to form the nip with the pressing roller 110 before the thermoprotector 105 disconnects current supply to the current-passing heating resistive layer 101*b*.

At that time, if only an AC supply portion of the heater 101 is interrupted, there is no electrical problem because current supply is disconnected, although the problem of destruction of the heater 101 is present. However, if a DC supply portion starting from the temperature detection device 104 is interrupted, there is the possibility that an AC supply portion and the DC supply portion short-circuit, resulting in, in the worst case, destruction of an electronic-component unit of the main body of the image forming apparatus. In order to solve such a problem, a configuration has been devised in which, as shown in FIG. 8(*a*), a through hole 101*d* is formed at a portion other than the DC supply region on the ceramic substrate 101*a* so as to assuredly interrupt only the AC supply portion due to stress concentration generated at the through hole 101*d* by heat and pressure. This configuration, however, causes problems because manufacturing the heater 101 is complicated, for example, by providing the through hole, and the production cost increases due to an increase in the number of processes.

SUMMARY OF THE INVENTION

It is an object of the present invention to provide an image heating device and a heating device with an improved thermoprotector for disconnecting electric power supply to a heater when there is excessive temperature rise.

It is another object of the present invention to provide an image heating device and a heating device in which a bimetal of a thermoprotector contacts a heater.

In accordance with these objects, there is provided an image heating device comprising a heater generating heat upon electric power supply thereto and a film having one surface in slidable contact with the heater and another surface moving together with a recording material bearing an image while in contact with the recording material, the image on the recording material being heated by heat from the heater through the film. A thermoprotector is placed in contact with the heater and comprises a bimetal, the shape of which mechanically changes when there is an excessive temperature rise in order to disconnect electric power supply to the heater, the bimetal being in direct contact with the heater.

In Accordance with another aspect of the invention, there is provided a heating device comprising a heater generating heat upon electric power supply thereto and a thermoprotector in contact with the heater. The thermoprotector comprises a bimetal, the shape of which mechanically changes when there is an excessive temperature rise in order to disconnect electric power supply to the heater, the bimetal of the thermoprotector contacting the heater.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Preferred embodiments of the present invention will now be described with reference to the drawings.

First, a first embodiment of the present invention will be described with reference to FIGS. 1 through 4.

Figure 1:
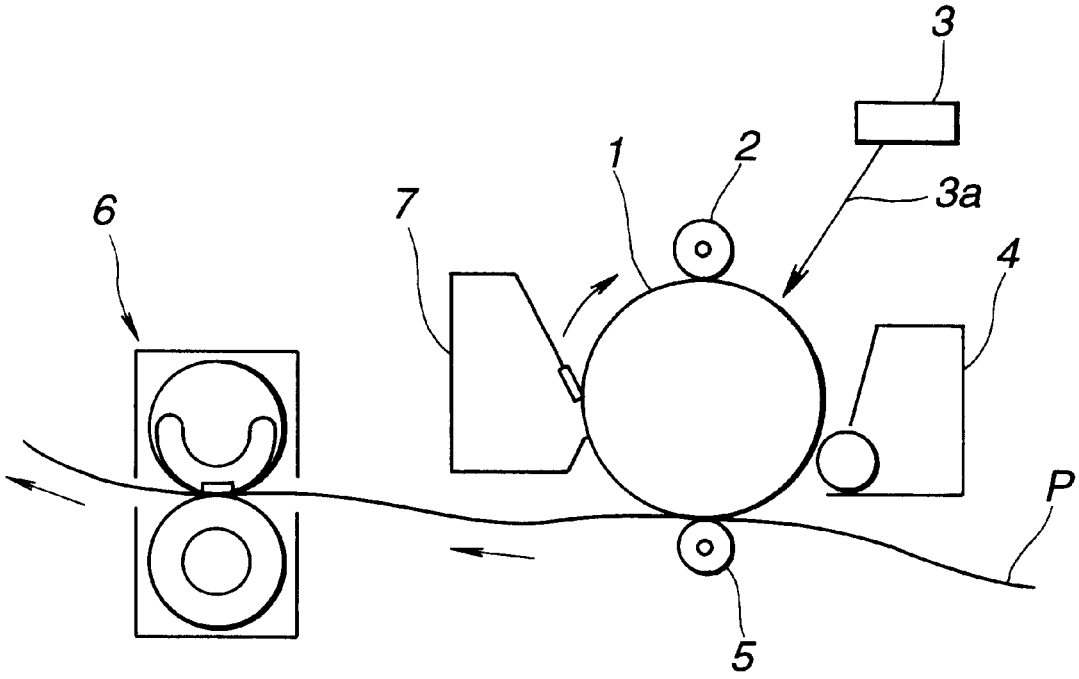
FIG. 1 is a schematic diagram illustrating the configuration of an image forming apparatus to which the present invention is applied.

FIG. 1 is a schematic diagram illustrating the configuration figuration of an image forming apparatus in which a heat fixing device, serving as an image heating device, according to a first embodiment of the present invention. The image forming apparatus includes a photosensitive drum 1 on the surface of which an electrostatic latent image is to be formed, a charging roller 2, serving as a charging device for uniformly charging the surface of the photosensitive drum 1, an exposure device 3 for forming an electrostatic latent image on the photosensitive drum 1, a developing device 4 for developing the electrostatic latent image formed on the photosensitive drum 1 by a toner, to visualize the latent image, a transfer roller 5 serving as a transfer device for transferring the visualized toner image onto a recording material, a heating fixing device 6 for fixing the toner image transferred on the recording material by heating and fusing the toner, and a cleaning device 7 for removing toner particles remaining on the photosensitive drum 1 after the image transfer.

The photosensitive drum 1 comprises a layer made of a photosensitive material, such as an OPC (organic photoconductor), amorphous Se, amorphous Si or the like, provided on a cylindrical base member made of aluminumm, nickel or the like. The photosensitive drum 1 is rotatably driven in the direction of an arrow shown in FIG. 1 at a predetermined circumferential speed. First, the surface of the photosensitive drum 1 is uniformly charged by the charging roller 2. Then, scanning exposure by a laser beam 3*a* subjected to on/off control in accordance with image information is performed by the exposure device 3, to form an electrostatic latent image. The electrostatic latent image is developed by the developing device 4, to visualize the latent image. The development is performed according to a jamping developing method, a two-component developing method, a FEED developing method or the like. In most cases, image exposure and reversal development are combined.

The visualized toner image is transferred by the transfer roller 5 from the photosensitive drum 1 onto a recording material P conveyed at a predetermined timing. At that time, the recording material P is conveyed by being grasped by the photosensitive drum 1 and the transfer roller 5 with a constant pressure. The recording material P having the toner image transferred thereon is conveyed to the heating fixing device 6, which fixes the toner image by pressing and fusing the toner, to provide a permanent image. After transferring the toner image onto the recording material P, toner particles remaining on the photosensitive drum 1 are removed from the surface of the photosensitive drum 1 by the cleaning device 7.

Figure 2:
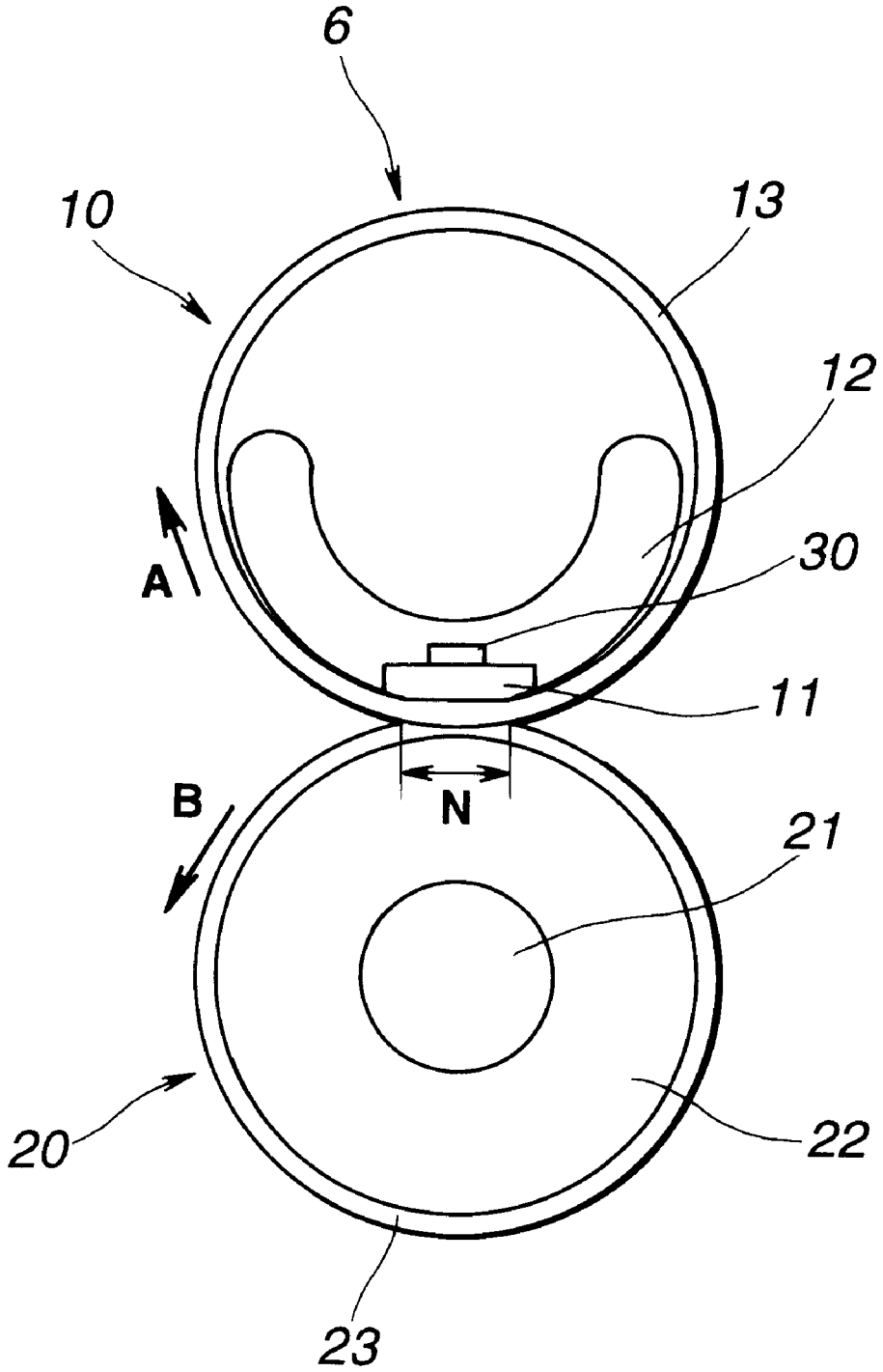
FIG. 2 is a schematic diagram illustrating the configuration of an image heating device according to a first embodiment of the present invention.

FIG. 2 is a schematic diagram illustrating the configuration of the heating fixing device 6 in FIG. 1. In FIG. 2, the heating fixing device 6 includes a fixing member 10 having a heater, and a pressing roller 20 in pressure contact with the fixing member 10. By passing the recording material through a fixing nip portion N formed between the fixing member 10 and the pressing roller 20, the toner image on the recording material is fixed by being pressed and fused.

The fixing member 10 of the heating fixing device 6 includes a fixing film 13 having the shape of a cylinder or an endless belt, a heater 11 disposed within the fixing film 13 in a stably fixed state, and an adiabatic stay holder 12 for holding the heater 11 and guiding the fixing film 13.

The fixing film 13 is formed by laminating films of polyimide, polyamide imide, PEEK, PES, PPS, PFA, PTFE, FEP or the like having a small heat capacity, and a heat resistant property with a thickness equal to or less than 100 $\mu$m, so as to allow quick start of the heating fixing device 6.

In order to provide a fixing film having a sufficient strength and excellent durability for realizing a long-life heating fixing device, it is necessary that the fixing film has a thickness of at least 20 $\mu$m. Accordingly, the optimum thickness of the fixing film 13 is at least 20 $\mu$m and equal to or less than 100 $\mu$m.

The surface of the fixing film 13 is coated with a heat-resistant resin having excellent releasability, such as PFA, PTFE, FEP or the like, or a mixture of these resins, in order to prevent offset and to secure a property to separate the recording material.

Figure 3:
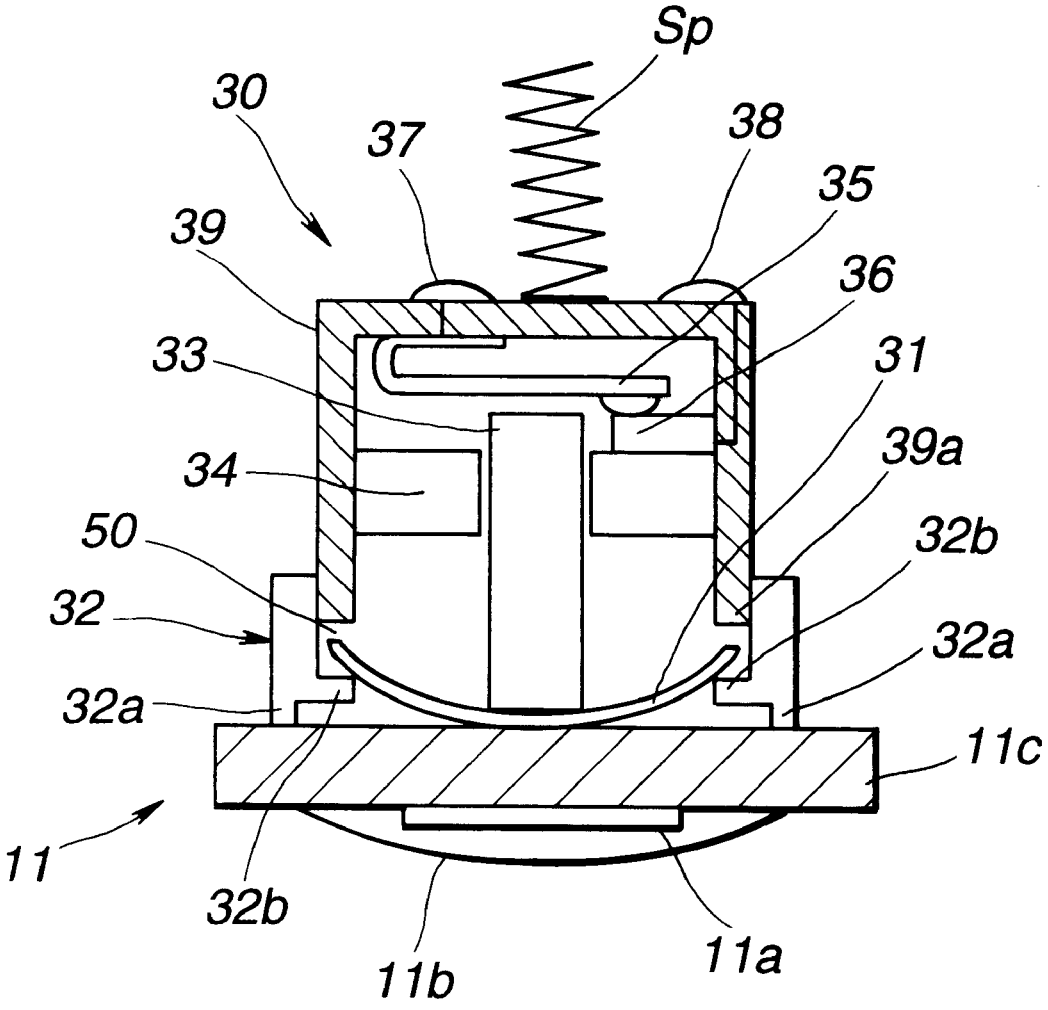
FIG. 3 is an enlarged view illustrating the heater and a thermoprotector shown in FIG. 2.

As shown in FIG. 3, the heater 11 disposed within the fixing film 13 comprises a ceramic substrate 11*c* having an electric insulating property, an excellent thermal conductivity and a low heat capacity. The ceramic substrate 11*c* may be made of alumina or the like. A heat generating member 11*a* is made of silver/palladium (Ag/Pd), TazN or the like, and is provided on a surface of the ceramic substrate 11*c* contacting the fixing film 13 in the longitudinal direction of the ceramic substrate 11*c*, and an overcoated layer 11*b* provided so as to cover the heat generating member 11*a*. By supplying electric power (current) through the resistive heat generating member 11*a*, the nip portion for fusing and fixing the toner image on the recording material is heated.

A thermoprotector 30 for disconnecting electric power supply to the heater 11 when there is excessive temperature rise in the heater 11 is provided on a surface of the ceramic substrate 11*c* opposite to the surface where the heat generating member 11*a* is provided. The heater 11, the thermoprotector 30 and the like constitute the heating device. In the first embodiment, the thermoprotector 30 is mounted on the heater 11, so that the heater 11 includes the thermoprotector 30.

Figure 6A:
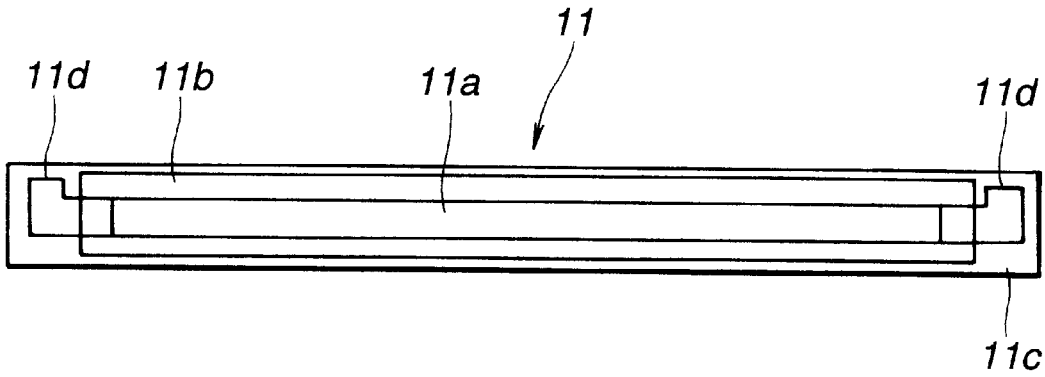
FIGS. 6(*a*) and 6(*b*) are diagrams illustrating the configuration of the heater shown in FIG. 2.
Figure 6B:
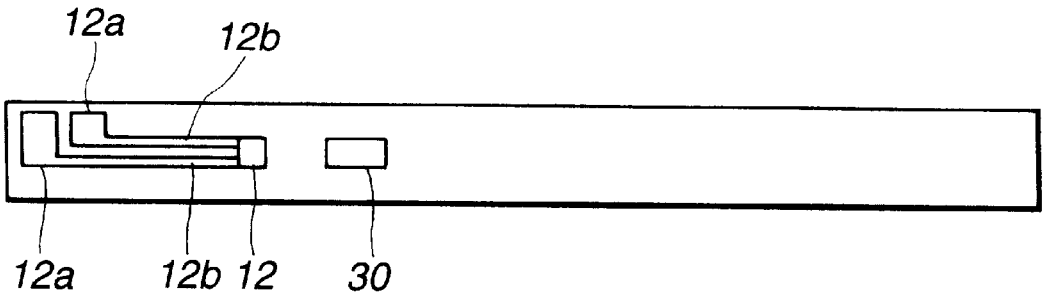
Figure 7:
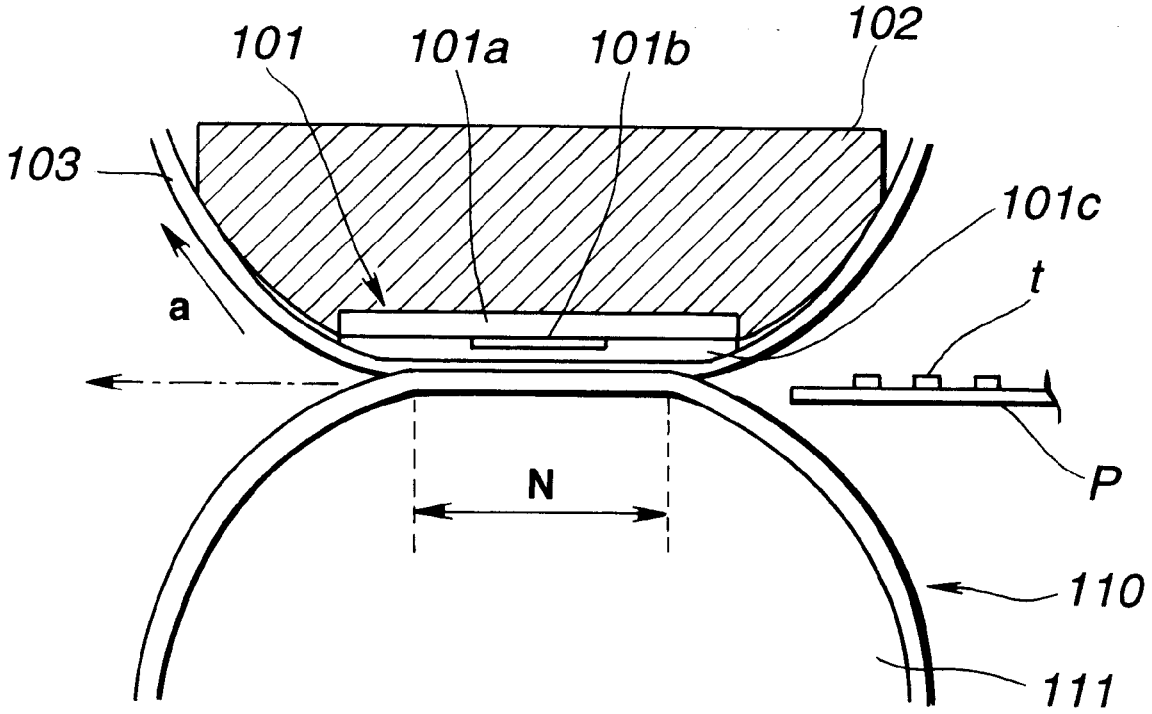
FIG.7 PRIOR ART
FIG. 7 is a diagram illustrating an image heating device which constitutes a background technique of the present invention.
Figure 8A:
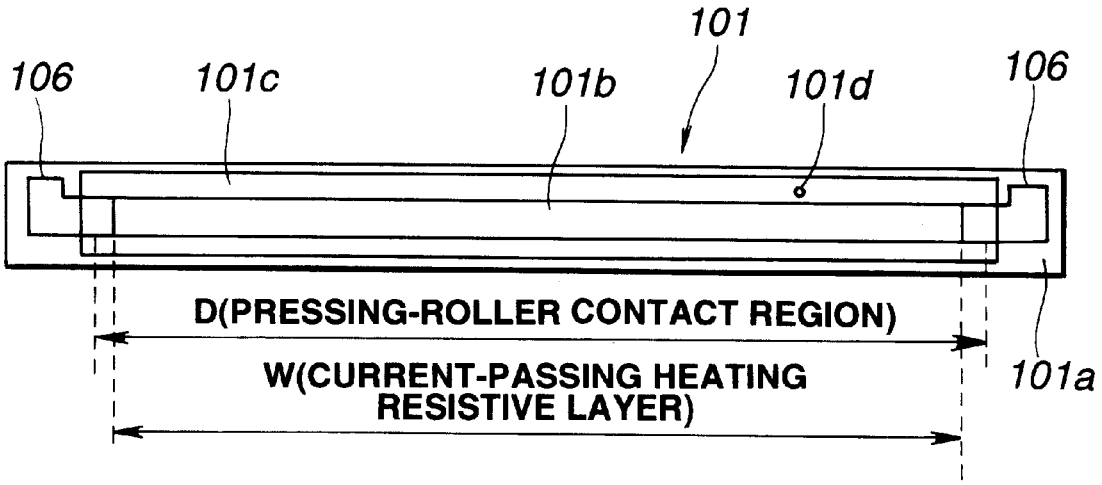
FIG.8(a) PRIOR ART
FIGS. 8(*a*) and 8(*b*) are diagrams illustrating the configuration of a heater shown in FIG. 7.
Figure 8B:
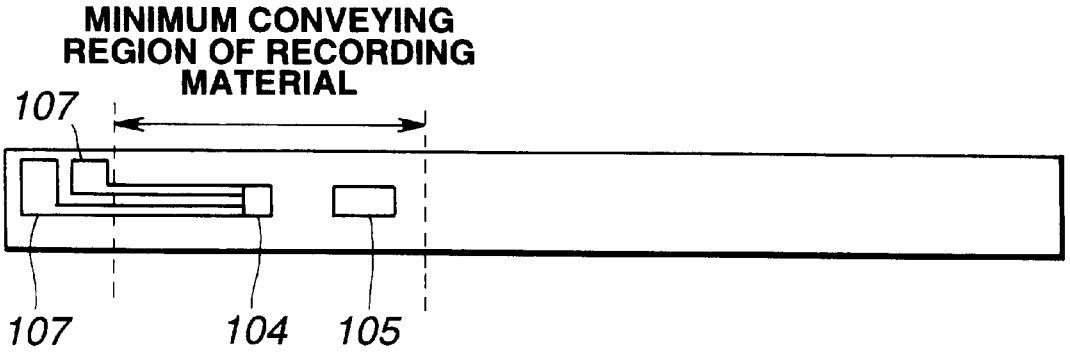
FIG.8(b) PRIOR ART

FIGS. 6(*a*) and 6(*b*) are a front view and a rear view, respectively, of the heater 11. The heater 11 has the shape of a long plate extending in a direction orthogonal to the moving direction of the fixing film 13. Reference numeral 11*d* represents electrodes (AC electrode portions) for supplying electric power through the heat generating member 11*a*. A temperature detector 12 detects the temperature of the heater 11. Reference numeral 12*a* represents electrodes (DC electrode portions) for supplying electric power through the temperature detector 12. Conductive patterns electrically connect the temperature detector 12 to the electrodes 12*a*. The electrodes 11*d*, the temperature detector 12, the electrodes 12*a* and the conductive patterns 12*b* are provided on the ceramic substrate 11*c*.

The stay holder 12 for holding the heater 11 is made of an adiabatic liquid-crystal polymer, a phenol resin, PPS, PEEK or the like, and prevents the heat of the heater 11 from radiating in a direction opposite to the nip portion. The fixing film 13 is loosely fitted around the outer circumference of the stay holder 12 with sufficient allowance so as to be rotatable in a clockwise direction indicated by an arrow A.

Since the fixing film 13 rotates while slidably contacting the heater 11 and the adiabatic stay holder 12 provided within the fixing film 13, it is necessary to minimize the frictional resistance between the heater 11 and the adiabatic stay holder 12, and the fixing film 13. For that purpose, a small amount of lubricant, such as heat-resistant grease or the like, is coated on the surfaces of the heater 11 and the adiabatic stay holder 12, so that the fixing film 13 can be smoothly rotated.

The pressing roller 20, serving as a back up member contacting the fixing member 10, comprises a core bar 21, an elastic layer 22, made of a heat-resistant rubber, such as a silicone rubber, a fluororubber or the like, or is formed by foaming a silicone rubber provided on the outer surface of the core bar 21, and a releasing layer 23, made of PFA, PTFE, FEP or the like, formed on the elastic layer 22. The pressing roller 20 is sufficiently pressed against the fixing member 10 by pressing means (not shown) at both end portions in the longitudinal direction, so as to form a nip portion necessary for thermal fixing, and is rotatably driven in a counterclockwise direction indicated by an arrow B shown in FIG. 2 by rotation driving means (not shown). In accordance with the rotation of the pressing roller 20, the fixing film 13 is rotatably driven in a clockwise direction indicated by an arrow A shown in FIG. 2 along the outer circumference of the stay holder 12. The fixing film 13 may be rotated by providing a driving roller for rotating the fixing film 13 and rotatably driving the driving roller. The pressing roller 20 forms a nip with the heater 11 via the fixing film 13.

FIG. 3 is a partial cross-sectional view illustrating he thermoprotector 30 provided at a side of the heater 11 opposite to the nip portion.

In the thermoprotector 30, provided on the heater 11, for disconnecting electric power supply to the heater 11 when there is excessive temperature rise of the heater 11, a disc 31 made of a bimetal obtained by bonding together a nickel alloy and a copper alloy having different coefficients of thermal expansion is held between a disc holder 32 made of a thermosetting or thermoplastic heat-resistant resin or a ceramic material, and a housing 39 in a free state of having a gap 50 movable in directions perpendicular and horizontal to the plane of the ceramic substrate 11*c* in an ordinary state. A butt portion 32*a* protrudes from a lower portion of the disc holder 32. The butt portion 32*a* can provide a constant gap between the main body of the disc holder 32 and the heater 11 so as to appropriately maintain a state of the disc 31 before reversal by contacting the ceramic substrate 11c. The butt portion 32*a* preferably performs point contact with the ceramic substrate 11*c* at at least three points in order to prevent dissipation of heat from the heater 11. The absence of the butt portion 32*a* is undesirable, because in that case the contact surface between the disc 31 and the heater 11 becomes large, resulting in an increase in local dissipation of heat from the heater 11.

The disc 31 within the disc holder 32 is formed so as to be concave at a central portion. Hence, a circumferential portion of the disc 31 is engaged with an engaging projection 32*b* protruding inward at a lower portion of the disc holder 32, in a state of being separated from a surface of the heater 11 opposite to the surface where the heating member 11*a* is provided. In an ordinary state, the apex of the curved surface of the disc 31 contacts the flat portion (the substrate) of the heater 11 due to the disc's own weight. When there is excessive temperature rise in the heater 11, the central portion of the disk 31 mechanically changes and is reversed upward in the state in which the circumferential portion of the disk 31 is supported by the engaging projections 32*b*. That is, the disc 31 is supported so as to be movable in the space 50 provided between an end portion 39*a* of the housing 39, and the engaging projection 32*b*.

The housing 39 is provided so as to contact an upper portion of the disc holder 32. A movable pin 33, made of a heat-resistant resin or a ceramic material, provided as electric power-supply disconnection means for disconnecting electric power supply to the heater 11 during reversal of the disc 31, is disposed above the disc 31 within the housing 39. The movable pin 33 is slidably held by a pin guide 34, made of a heat-resistant resin or a ceramic material, and protruding within the housing 39. Hence, the movable pin 33 can smoothly move in a direction perpendicular to the flat portion of the heater 11 while being guided by the pin guide 34 during reversal of the disc 31.

In the state shown in FIG. 3, the lower end of the movable pin 33 contacts the surface of the disc 31 as a result of the pin's own weight. It is necessary that, in order to maintain smooth sliding movement of the movable pin 33, the disc holder 32, the movable pin 33 and the pin guide 34 do not soften or melt at a temperature sufficiently higher than the reversal temperature of the bimetal disc 31. Hence, each of these members is desirably made of a thermosetting resin selected from phenol, polyamide and the like, or a thermoplastic resin selected from PPS containing glass, LCP, polyamide, polyimide and the like.

A switching arm 35 made of an elastic copper alloy is disposed above the movable pin 33. In an ordinary state, the base end of the switching arm 35 is electrically connected to an electrode 37 provided on the housing 39, and the distal end of the switching arm 35 contacts a contact plate 36 provided on the pin guide 34 within the housing 39. The contact plate 36 is electrically connected to an electrode 38, and electrodes 37 and 38 are connected to a power-supply circuit of the heater 11, so that electric power is supplied to the heater 11 in a state in which the distal end of the switching arm 35 contacts the contact plate 36. In an ordinary state, a small gap is present between the movable pin 33 and the switching arm 35. The disc holder 32, the pin guide 34, the switching arm 35, the contact plate 36, and the electrodes 37 and 38 are fixed on the housing 39. A lower portion of the housing 39 is supported by the disc holder 32, and the housing 39 is pressed against the substrate 11*c* of the heater 11 by an elastic member, such as a spring Sp or the like.

Figure 4:
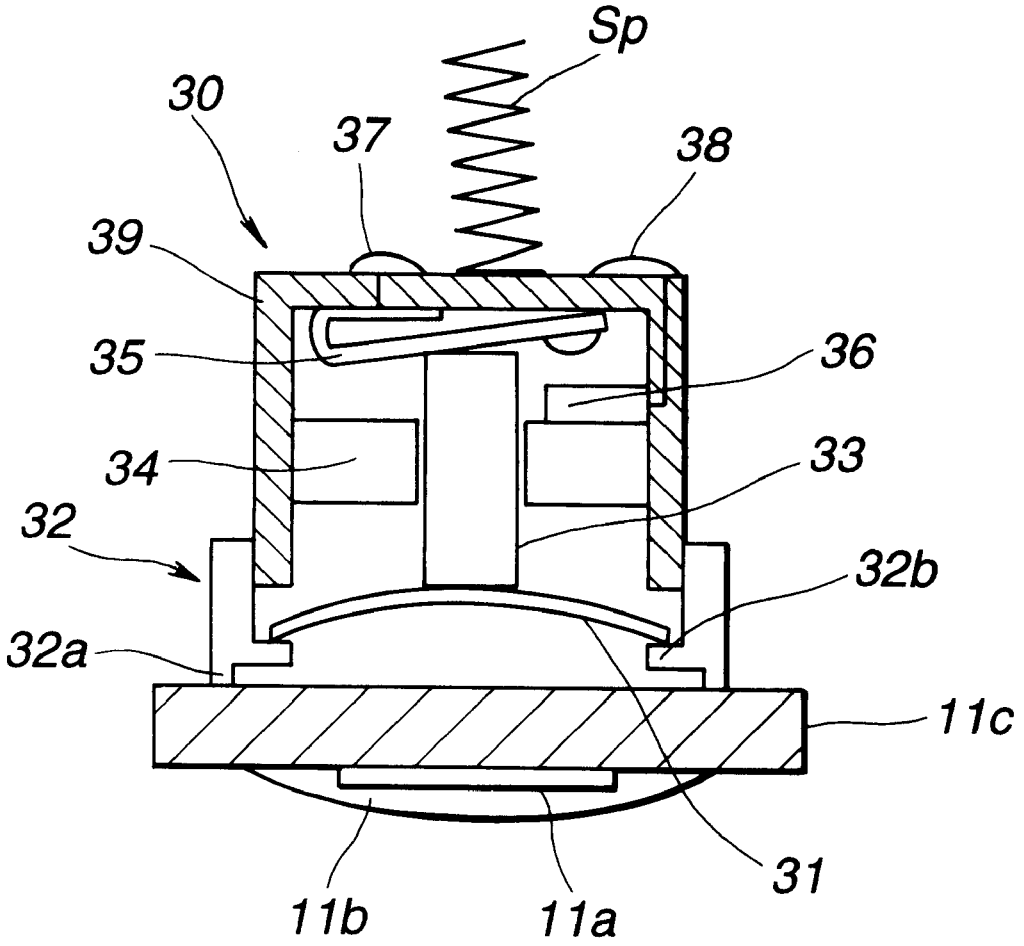
FIG. 4 is a diagram illustrating a state in which the thermoprotector operates.

FIG. 4 illustrates a state in which the bimetal disc 31 is reversed when the temperature of the heater 11 is too high. As shown in FIG. 4, in accordance with the reversal of the disc 31, the engaging projection 32*b* of the disc holder 32 holds the circumferential portion of the disc 31. At that time, the movable pin 33 is moved upward, so that the upper end of the movable pin 33 raises the switching arm 35, to disconnect electric connection to the contact 36, and thereby to disconnect current supply to the heater 11.

Since the bimetal disc 31 directly contacts the substrate 11*c* of the heater 11, the response when the bimetal disc 31 is reversed is very quick. The response speed of the thermoprotector 30 of the first embodiment (the time period until the thermoprotector 30 operates when the temperature of the heater 11 is raised at a constant condition in a state in which the thermoprotector 30 contacts the back surface of the heater 11) is 2–3 times the response speed of a thermoswitch, a temperature fuse or the like which is packaged in an ordinary state.

For example, when 100 V was continuously supplied to a 100-V/200-W heater without performing temperature control, the thermoprotector of the first embodiment operated in 9 seconds after start of the electric power supply, in contrast to 20 seconds and 30 seconds in the case of a conventional temperature fuse and a conventional thermoswitch, respectively. When increasing the electric power supplied to the heater to 400 W when using a conventional temperature fuse or thermoswitch, the substrate of the heater was broke in about 12 seconds, before the thermoprotector operated to disconnect electric power supply to the heater. On the other hand, the thermoprotector of the first embodiment operated in 6 seconds, before the substrate of the heater was broken, to disconnect electric power supply to the heater.

As in the first embodiment, by contacting a bimetal on a stably fixed heater, and causing a holding member (disc holder) disposed with a constant gap with the heater to hold the bimetal so as to be movable in vertical and horizontal directions, it is possible to provide a structure in which the bimetal is reversed when there is excessive rise of the temperature of the heater and not reversed due to external vibration or the like.

As described above, in the first embodiment, since the substrate of the heater directly contacts the bimetal, the bimetal contacting the heater is instantaneously reversed when there is excessive temperature rise in the heater, to disconnect electric power supply to the heater. Hence, the response of the thermoprotector is remarkably improved, electric power supply to the heater when there is excessive temperature rise in the heater can be assuredly disconnected without breaking the ceramic substrate of the heater, and a heating fixing device including a high-productivity heater can be provided.

Figure 5:
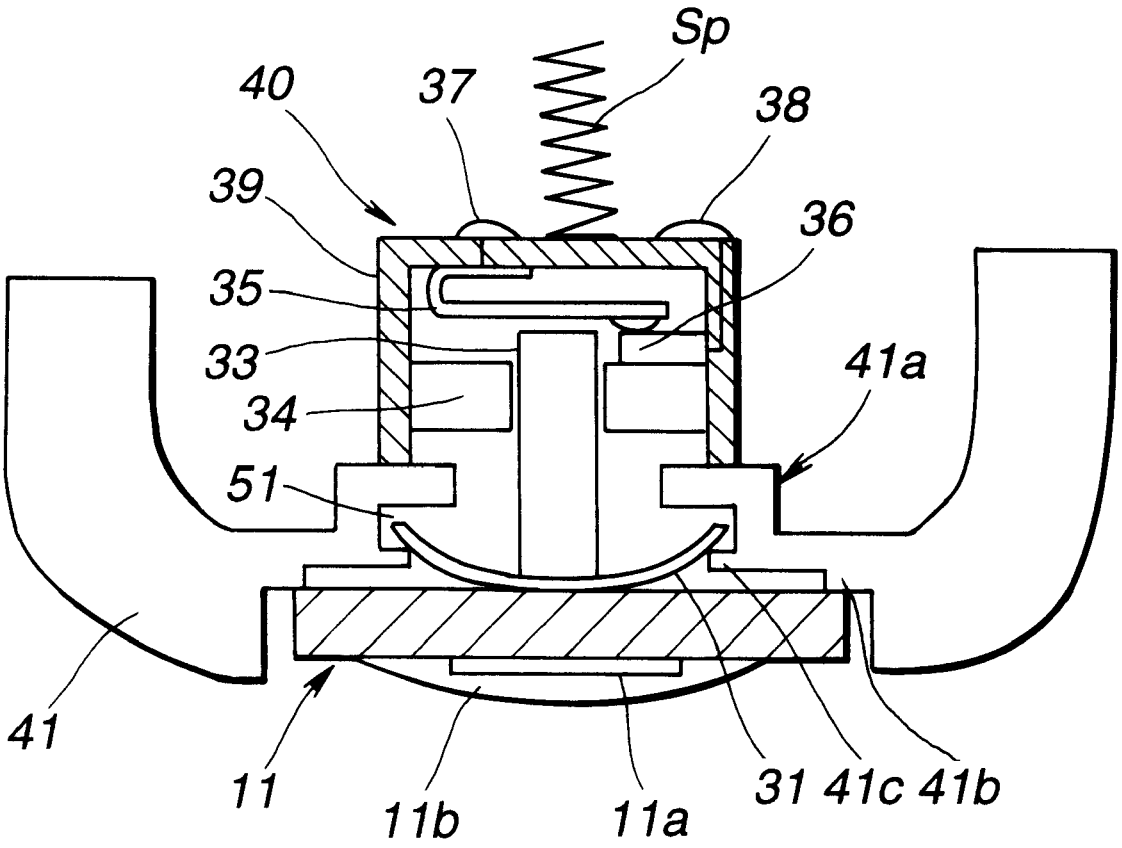
FIG. 5 is a diagram illustrating a second embodiment of the present invention.

A second embodiment of the present invention will now be described with respect to FIG. 5. FIG. 5 is a partical cross-sectional view illustrating a thermoprotector according to the second embodiment. A principal portion of a heating fixing device to which the thermoprotector of the second embodiment is applied is the same as in the first embodiment. Hence, further description thereof will be omitted.

The thermoprotector of the second embodiment has a configuration in which a holding member for holding a bimetal and a stay holder for holding a heating member are integrally formed, and the stay holder holds the bimetal. The holding member of the bimetal does not contact the surface of the heating member.

In a thermoprotector 40, provided on a heater 11, for disconnecting electric power supply to the heater 11 when there is excessive temperature rise in the heater 11, a disc 31 made of a bimetal obtained by bonding together a nickel alloy and a copper alloy having different coefficients of thermal expansion is held by a disc holder portion 41*a* of a stay holder 41 made of a thermosetting or thermoplastic heat-resistant resin or a ceramic material, in a free state of having a constant gap 51 in directions perpendicular and horizontal to the plane of a heater substrate in an ordinary state.

Since the disc holder portion 41*a* is integrated with the stay holder 41 for holding the heater 11, a butt portion 41*b* for the surface of the heater 11, which is provided so as to maintain a constant gap between the disc holder portion 41*a* and the surface of the heater 11 in order to provide an appropriate state of the disc 31 before reversal, also operates as a contact portion of the stay holder 41 with the heater 11. Accordingly, the butt portion 41*b* is provided at a position separated from a heat generating member 11*a* of the heater 11, to prevent the heat of the heater 11 from being dissipated by being conducted to the butt portion 41*b*.

The disc 31 within the disc holder portion 41*a* is formed so as to be concave at a central portion. Hence, a circumferential portion of the disc 31 is engaged with an engaging projection 41*c* protruded inward at a lower portion of the disc holder portion 41*a*, in a state of being separated from a surface of the heater 11 opposite to the surface where the heat generating member 11*a* is provided. In an ordinary state, the apex of the curved surface of the disc 31 contacts the flat portion of the heater 11 due to the disc's own weight. When there is excessive temperature rise in the heater 11, the central portion of the disk 31 is reversed upward in the state in which the circumferential portion of the disk 31 is supported by the engaging projection 41*c*.

A housing 39 as in the first embodiment is provided above the disc holder portion 41*a*. A movable pin 33, made of a heat-resistant resin or a ceramic material, serving as electric power-supply disconnection means for disconnecting electric power supply to the heater 11 during reversal of the disc 31, is disposed above the disc 31 within the housing 39. The movable pin 33 is slidably held by a pin guide 34, made of a heat-resistant resin or a ceramic material, protruded within the housing 39. Hence, the movable pin 33 can smoothly move in a direction perpendicular to the flat portion of the heater 11 by being guided by the pin guide 34 in accordance with reversal of the disc 31.

As in the first embodiment, a switching arm 35 is disposed above the movable pin 33. In an ordinary state, the base end of the switching arm 35 is electrically connected to an electrode 37 provided on the housing 39, and the distal end of the switching arm 35 contacts a contact plate 36 provided on the pin guide 34 within the housing 39. The contact plate 36 is electrically connected to an electrode 38, and electrodes 37 and 38 are connected to a power-supply circuit of the heater 11, so that current is supplied to the heater 11 in a state in which the distal end of the switching arm 35 contacts the contact plate 36. The disc holder portion 41*a* is integrated with the stay holder 41. The pin guide 34, the switching arm 35, the contact plate 36, and the electrodes 37 and 38 are fixed to the housing 39 which is fixed on an upper portion of the disc holder portion 41*a*. An upper portion of the housing 39 is pressed against the substrate of the heater 11 by an elastic member, such as a spring Sp or the like.

By thus forming the disc holder as one body with the stay holder, accuracy in the contact position of the bimetal with the surface of the substrate of the heater is improved, in addition to the advantages described in the first embodiment. Furthermore, since it is unnecessary to provide a butt portion of the disc holder for the heater, it is unnecessary to consider dissipation of heat from the heater in the thermoprotector, and it is possible to reduce the number of components and to achieve reduction in the production cost.

The individual components shown in outline in the drawings are all well-known in the image heating device and heating device arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims.

What is claimed is:

1. An image heating device comprising:

a heater including a substrate and a heat generating member provided on said substrate, wherein said heat generating member heat upon electric power supply thereto;

a film having one surface in slidable contact with said heater, and another surface moving together with a recording material bearing an image while in contact with the recording material, the image on the recording material being heated by heat from said heater through said film; and a thermoprotector including a bimetal the shape of which mechanically changes when there is an excessive temperature rise, in order to disconnect electric power supply to said heat generating member, wherein at nonexcessive temperatures the bimetal of said thermoprotector is in direct contact with the substrate of said heater.

2. A device according to claim 1, wherein said heater comprises a heat generating member generating heat upon electric power supply and a substrate on which said heat generating member is provided, and wherein said bimetal contacts said substrate.

3. A device according to claim 1, further comprising temperature detection means being provided on said substrate for detecting a temperature of said heater.

4. A device according to claim 1, wherein said heater is stationary.

5. A device according to claim 1, further comprising a holding member for holding said heater, wherein said holding member also holds said bimetal.

6. A device according to claim 1, further comprising a back up member for forming a nip with said heater with said film interposed therebetween, wherein the recording material bearing an unfixed image is conveyed by being grasped in the nip, to fix the unfixed image on the recording material.

7. A heating device comprising:

a heater including a substrate and a heat generating member provided on said substrate, wherein said heat generating member generates heat upon electric power supply thereto; and a thermoprotector including a bimetal the shape of which mechanically changes when there is an excessive temperature rise, in order to disconnect electric power supply to said heat generating member, wherein at nonexcessive temperatures the bimetal of said thermoprotector is in direct contact with the substrate of said heater.

8. A device according to claim 7, wherein said heater comprises a heat generating member generating heat upon electric power supply and a substrate on which said heat generating member is provided, and wherein said bimetal contacts said substrate.

9. A device according to claim 7, further comprising temperature detection means being provided on said substrate for detecting a temperature of said heater.

* * * * *

UNITED STATES PATENT AND TRADEMARK OFFICE

CERTIFICATE OF CORRECTION

PATENT NO. : 6,075,228

DATED : June 13, 2000

INVENTOR(S): MASAHIRO GOTO, ET AL.

It is certified that error appears in the above-identified patent and that said Letters Patent is hereby corrected as shown below:

COLUMN 1:
Line 52, "Ta2N" should read --$Ta_2N$--.

COLUMN 5:
Line 25, "aluminumm," should read --aluminum,--.
Line 35, "jamping" should read --jumping--.

COLUMN 6:
Line 20, "TazN" should read --$Ta_2N$--.

COLUMN 7:
Line 20, "he" should read --the--.

COLUMN 8:
Line 66, "broke" should read --broken--.

COLUMN 9:
Line 25, "partical" should read --partial--.

UNITED STATES PATENT AND TRADEMARK OFFICE

CERTIFICATE OF CORRECTION

PATENT NO. : 6,075,228

DATED : June 13, 2000

INVENTOR(S): MASAHIRO GOTO, ET AL.

It is certified that error appears in the above-identified patent and that said Letters Patent is hereby corrected as shown below:

COLUMN 10:
Line 62, "heat" should read --generates heat--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*